US010583340B2

(12) United States Patent
Lanyon

(10) Patent No.: US 10,583,340 B2
(45) Date of Patent: Mar. 10, 2020

(54) BASEBALL BAT WITH PERFORMANCE LIMITING CORE

(71) Applicant: Anarchy Bat Company Inc., Winnipeg (CA)

(72) Inventor: Kevin J. Lanyon, Winnipeg (CA)

(73) Assignee: Anarchy Bat Company Ltd., Winnipeg (CA)

( * ) Notice: Subject to any disclaimer, the term of this patent is extended or adjusted under 35 U.S.C. 154(b) by 0 days.

(21) Appl. No.: 15/617,149

(22) Filed: Jun. 8, 2017

(65) Prior Publication Data

US 2017/0354854 A1 Dec. 14, 2017

Related U.S. Application Data

(60) Provisional application No. 62/348,341, filed on Jun. 10, 2016.

(51) Int. Cl.

| | |
|---|---|
| ***A63B 60/54*** | (2015.01) |
| ***A63B 59/56*** | (2015.01) |
| ***A63B 59/50*** | (2015.01) |
| ***A63B 102/18*** | (2015.01) |

(52) U.S. Cl.

CPC ..... *A63B 60/54* (2015.10); *A63B 59/50* (2015.10); *A63B 59/56* (2015.10); *A63B 2102/18* (2015.10); *A63B 2102/182* (2015.10); *A63B 2209/00* (2013.01); *A63B 2209/02* (2013.01)

(58) Field of Classification Search

CPC ..... A63B 60/54; A63B 59/50; A63B 2102/18; A63B 2209/00

See application file for complete search history.

(56) References Cited

U.S. PATENT DOCUMENTS

| | | | | |
|---|---|---|---|---|
| 3,830,496 | A * | 8/1974 | Reizer | A63B 59/56 473/567 |
| 5,511,777 | A | 4/1996 | McNeely | |
| 5,533,723 | A * | 7/1996 | Baum | A63B 59/52 156/245 |
| 6,398,675 | B1 | 6/2002 | Eggiman et al. | |
| 6,663,517 | B2 | 12/2003 | Buiatti et al. | |
| 9,005,056 | B2 | 4/2015 | Pegnatori | |

(Continued)

FOREIGN PATENT DOCUMENTS

| | | |
|---|---|---|
| CA | 2333825 | 1/2001 |

*Primary Examiner* — Jeffrey S Vanderveen

(74) *Attorney, Agent, or Firm* — Ryan W. Dupuis; Ade & Company Inc.; Kyle R. Satterthwaite

(57) ABSTRACT

A baseball bat, that is formed of an elongate shell including a striking section, a handle section and a tapered section between the striking section and the handle section, further includes a tubular damper member received within a portion of a hollow cavity of the striking section. The tubular damper member is reduced in diameter relative to the hollow cavity and is supported by a foam layer extending about a circumference of the tubular damper member and which is under resilient compression between the tubular damper member and the striking section of the shell which surrounds the tubular damper member. A barrier layer between the foam layer and the shell is bonded with a first adhesive to the shell and with a second adhesive to the barrier layer to prevent the first adhesive from migrating into the foam layer.

16 Claims, 2 Drawing Sheets

(56) References Cited

U.S. PATENT DOCUMENTS

| | | | | |
|---|---|---|---|---|
| 2001/0021678 | A1* | 9/2001 | Pitsenberger | A63B 60/54<br>473/564 |
| 2001/0046910 | A1* | 11/2001 | Sutherland | A63B 59/51<br>473/564 |
| 2004/0254035 | A1* | 12/2004 | Hoffman | A63B 69/0091<br>473/423 |
| 2009/0143176 | A1* | 6/2009 | Burger | A63B 59/50<br>473/564 |
| 2011/0111894 | A1* | 5/2011 | Thouin | A63B 60/10<br>473/564 |
| 2011/0183788 | A1* | 7/2011 | Smith | A63B 60/54<br>473/564 |
| 2015/0105189 | A1* | 4/2015 | Schullstrom | A63B 59/54<br>473/567 |

* cited by examiner

BASEBALL BAT WITH PERFORMANCE LIMITING CORE

This application claims the benefit under 35 U.S.C. 119(e) of U.S. provisional application Ser. No. 62/348,341, filed Jun. 10, 2016.

FIELD OF THE INVENTION

The present invention relates to a hollow baseball bat including a dampening member supported therein using a sleeve of resilient material.

BACKGROUND

Hollow shell baseball bats are known to be constructed of various materials, for example various metals and alloys as well as composite mixtures of fibers supported within a resin. Regardless of the material used, striking a ball with the hollow shell baseball bat results in some resilient deformation of the hollow shell together with a subsequent rebounding of the shell which enhances hitting performance. Providing a shell which undergoes more flex and deformation can increase hitting performance of the bat, but tends to reduce the longevity of the bat due to the additional stress imposed upon the material of the bat during larger impact deformations.

In some instance, it is known to resiliently suspend a dampening core within the striking barrel portion of the hollow shell of a bat in an attempt to further improve upon the performance enhancing rebounding effect. The following documents disclose various examples of a dampening core resiliently suspended within a hollow shell of a bat.

CA 2,333,825 by Fritzke et al discloses a bat having a dampening core which spans the entire striking portion and which is separated from the shell by only a very thin layer of resilient material so as to affect the rebounding performance even when the shell undergoes small deformations. The core spans the full length of the striking portion so as to position the core by longitudinally restricting the core within the striking portion.

U.S. Pat. No. 6,663,517 by Buiatti et al discloses about having a dampening core in which the core spans the full length of the striking portion also as a requirement for positioning the core longitudinally within the striking portion. The resilient layer between the core and the shell is again very small such that the rebounding performance is affected even when the shell undergoes small deformations.

Similarly, U.S. Pat. No. 6,398,675 by Eggiman et al provides a core which spans the full length of the striking portion to longitudinally restrict the core relative to the striking portion. The resilient layer between the core and the shell of the bat is again very small so as to affect rebounding performance even for small deformations.

U.S. Pat. No. 5,511,777 by McNeely discloses a baseball bat with a rebounding core which must extend the full length of the striking portion to longitudinally position the core relative to the bat. The resilient layer which suspends the core relative to the shell of the bat is under great compression so as to be reduced by up to 70% of its relaxed state volume with the intention of affecting rebounding performance even for small deformations.

U.S. Pat. No. 9,005,056 by Pegnatori discloses a core resiliently suspended within the shell of a bat by various means. Typically the core spans substantially the full length of the striking portion to assist in positioning the core relative to the shell of the bat. Typically a complex mechanical structure is required to resiliently suspend the core relative to the shell which is costly and unreliable in use.

In each instance in the prior art, the core is required to be of considerable length to assist in positioning the core relative to the shell, however, the core is typically unnecessarily long resulting in an undesirable weight distribution within the bat. Reducing the length of the core according to the teachings of the prior art results in unsolved problems as to how to adequately secure the core relative to the shell. Typical adhesives which are suitable for bonding to common materials used to form the shell of bats, for example metal and composite barrels, tend to migrate into typical resilient materials for resiliently suspending the core relative to the shell, which in turn affects the long-term performance of the resilient material. The unitary resilient layer found in the typical prior art examples for supporting the core relative to the shell is thus considerably limited in the type of material which can be used to avoid problems associated with adhesive bonding to the shell as a means of securing the core relative to the shell.

SUMMARY OF THE INVENTION

According to one aspect of the invention there is provided a baseball bat comprising:

an elongate shell including a striking section of first diameter, a handle section of a second diameter which is reduced relative to the first diameter and a tapered section extending between the tubular striking section and the handle section, the striking section including a hollow cavity therein;

a tubular damper member received within a portion of the hollow cavity, the tubular damper member being reduced in diameter relative to the hollow cavity;

a foam layer extending about a circumference of the tubular damper member and being joined to the tubular damper member, the foam layer being under resilient compression between the tubular damper member and the striking section of the shell which surrounds the tubular damper member;

a barrier layer between the foam layer and the shell;

a first adhesive bonding the barrier layer to the shell; and a second adhesive bonding the foam layer to the barrier layer.

By providing a barrier layer between the foam layer and the shell of the bat, a strong adhesive can be used at the interface with the outer shell without concern for the deterioration of the foam layer by the adhesive used to bond to the outer shell. Accordingly, a highly compressible foam material can be used which is not limited by the type of adhesives which can be used for bonding to the material of the shell of the bat. The barrier layer can also be formed of a different resilient material than the foam layer such that the combination of two different types of resilient material provides greater opportunity to achieve a desirable degree of rebound performance throughout a range of different impact deformations of the bat.

Use of a highly compressible foam may be beneficial as it does not interfere with initial deformation of the bat during striking until the foam layer is highly compressed against the damper member. Accordingly, the damper member does not substantially affect rebound performance within a small range of bat deformation, but does provide an upper limit to the amount of bat deformation within an upper range of striking force against a ball for increasing longevity of the bat while still providing a bat which rebounds well through a large range of deformations.

The barrier layer is preferably formed of a material which differs from a material of the foam layer.

Preferably the first adhesive and the second adhesive are different from one another.

Preferably the barrier layer is resistant to migration of the first adhesive therethrough. In one embodiment, the first adhesive comprises polyurethane.

An outer diameter of the damper member is preferably between 1.375 and 1.75 inches.

The damper member may be formed of ultra high molecular weight polyethylene.

Preferably an inner diameter of the damper member is greater than 1 inch.

The foam layer may be heat welded to the damper member at axially opposed ends of the damper member.

The material of the foam layer is preferably more compressible than a material of the barrier layer so as to be compressible to less than half a thickness of the material in a relaxed state.

The foam layer may be a closed cell, high density polyurethane foam. Preferably the foam layer has a radial thickness of at least 0.25 inches in a relaxed state.

The barrier layer may also comprise a foam material, for example an open cell, expanded polyethylene foam material.

The barrier layer may have a radial thickness of 0.125 inches in a relaxed state.

The shell may comprise a composite material of fibers within a resin.

A length of the damper member is preferably less than 4 inches in a longitudinal direction of the shell such that the damper member is spaced farther from an end of the shell than a length of the damper member in a longitudinal direction of the shell.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 1:
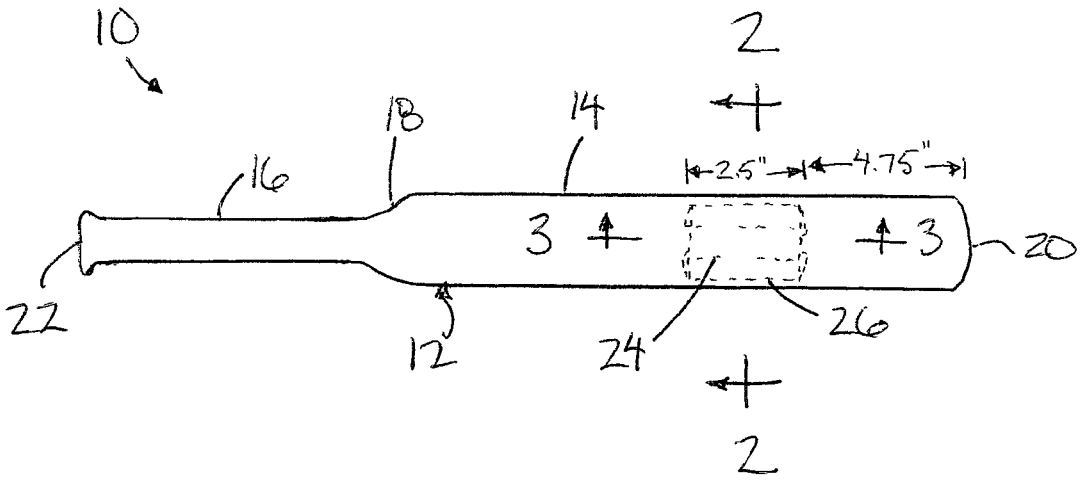
FIG. 1 is a schematic side view of a baseball bat according to a first embodiment of the present invention.

Referring to the accompanying figures there is illustrated a baseball bat generally indicated by reference numeral 10. When referring to a baseball bat herein, the term baseball bat is understood to be broadly interpreted as including all variations of baseball bats used in the sports of baseball, hardball, and/or softball.

The baseball bat 10 includes an outer shell 12 which is elongate in a longitudinal direction of the bat to define a hollow tubular outer boundary of the bat along the full length of the bat. The outer shell is shaped to define i) a striking section 14 having a constant diameter along the length thereof so as to be generally cylindrical in shape, ii) a handle section 16 opposite the striking section which is reduced in diameter relative to the striking section, and iii) a tapered section 18 connected between the striking section in the handle section. A cap 20 encloses the outermost end of the striking section. A butt end 22 encloses the outermost end of the handle section 16.

The shell is formed of a composite material such as carbon fibers embedded within a resin as a matrix. The radial thickness of the shell at the striking portion is approximately 0.165 inches between an inner diameter of 1.929 inches and an outer diameter of 2.094 inches.

Figure 2:
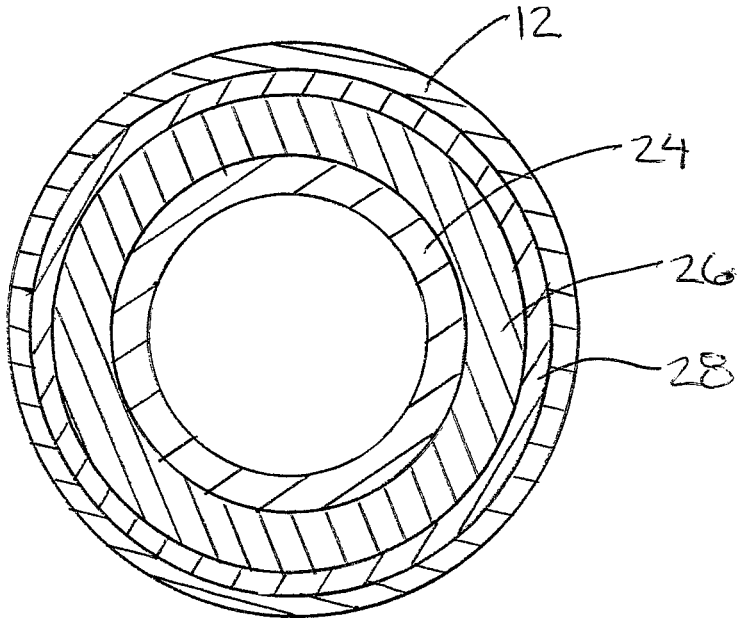
FIG. 2 is a sectional view along the line 2-2 of FIG. 1 according to the first embodiment.
Figure 3:
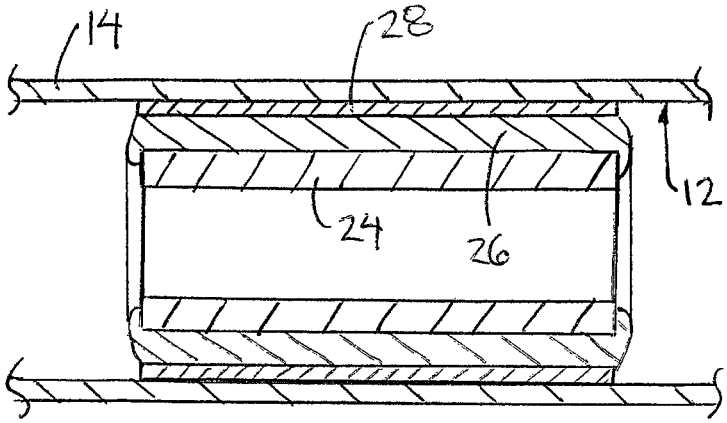
FIG. 3 is a sectional view along the line 2-2 of FIG. 1 according to the first embodiment.

The bat 10 also includes a damper member 24 resiliently supported within the hollow interior of the striking section 14 of the shell. The damper member is a rigid tube of ultra high molecular weight polyethylene having a hardness of 66 on the Shore D scale. In the illustrated embodiment of FIGS. 1 to 3, the inner diameter, the outer diameter and the radial thickness of the damper member between the inner and outer diameters is constant along a length of the damper member. More particularly, the damper member has an outer diameter of approximately 1.5 inches and an inner diameter of approximately 1.125 inches so as to have a thickness in the radial direction of approximately 3/16 of an inch. Overall, the damper member is preferably in the range of 1.375 to 1.7 inches in outer diameter.

Figure 4:
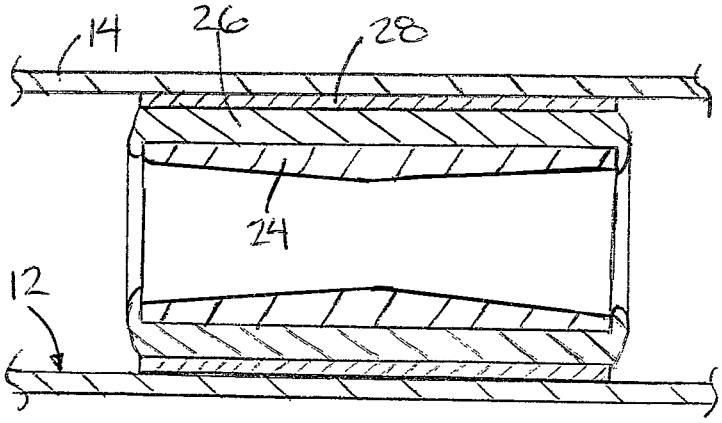
FIG. 4 is a sectional view along the line 2-2 of FIG. 1 according to a second embodiment of the baseball bat.

In an alternative embodiment according to FIG. 4, the radial wall thickness of the damper member 24 between inner and outer diameters thereof may vary along the length of the damper member. In this instance, the wall thickness is greatest at a longitudinal center of the damper member, and the thickness is gradually reduced in a tapered manner towards both longitudinally opposed ends of the damper member. More particularly, the outer diameter remains constant, but the inner diameter is gradually increased from the center towards both opposing ends.

In yet further embodiments, the outer diameter of the damper member may vary along the length thereof such that one or both of the foam layer and the barrier layer also vary in thickness in the longitudinal direction to fill the gap between the damper member and the surrounding shell of the bat.

The length in the longitudinal direction of the damper member is approximately 2.5 inches. The damper member is resiliently suspended concentrically within the striking section of the shell so as to be spaced by a distance of 4.75 inches from the end cap 20.

The damper member is resiliently suspended within the shell primarily by a foam layer 26 comprising a closed cell, high density polyurethane foam. The radial thickness of the foam layer in an uncompressed and relaxed state is approximately 0.25 inches. The foam material of the foam layer 26 spans the full-length and full circumference about the damper member. Longitudinally opposed ends of the foam material of the foam layer 26 are heat welded to the longitudinally opposed end faces of the damper member. In addition, a spray-on adhesive is applied to the outer surface of the damper member for providing an adhesive bond between the interface of the foam layer with the outer surface of the damper member.

A barrier layer 28 is provided in the form of a sheet of expanded polyethylene foam which spans the full-length of the outer surface of the foam layer 26 in the longitudinal direction of the bat as well as extending about the full circumference of the foam layer. A spray-on adhesive is again applied to the outer surface of the foam layer to which the barrier layer is bonded at the interface between the foam layer and the barrier layer. The barrier layer has a thickness in the radial direction which is 0.125 inches in an uncompressed and relaxed state.

The first foam material of the foam layer and the second foam material of the barrier layer collectively form a resilient portion of the bat that spans a radial thickness of ⅜ of an inch in a relaxed and uncompressed state, but when mounted within the shell of the bat the two layers of the resilient portion are compressed to a combined radial thickness of 0.2145 inches to span between the outer diameter of 1.5 inches of the damper member and the inner diameter of 1.929 inches of the shell.

A different adhesive material 30, for example a polyurethane adhesive is applied between the outer surface of the barrier layer and the inner surface of the surrounding portion of the outer shell 12. The polyurethane adhesive provides a very strong bond to the inner surface of the composite material forming the shell to fix the barrier layer relative to the material of the shell. The foam material of the barrier layer and the foam material of the foam layer are better suited for bonding with a lighter adhesive material which does not negatively affect the performance of the material of the foam layer. Similarly a light adhesive which does not affect the performance of the foam layer can be used between the foam layer and the damper member. The barrier layer functions as a barrier which resists migration of the polyurethane adhesive from the interface with the shell across the barrier layer to the foam layer. Accordingly the foam layer performance is not affected by the adhesive joining the barrier layer to the shell.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A baseball bat comprising:

an outer shell including a striking section of a first diameter, a handle section of a second diameter which is reduced relative to the first diameter and a tapered section extending between the tubular striking section and the handle section, the striking section including a hollow cavity therein;

a tubular damper member received within a portion of the hollow cavity, the tubular damper member being reduced in diameter relative to the hollow cavity, the tubular damper member being formed of a rigid material;

a resilient portion formed of foam materials that are more compressible than the rigid material of the tubular damper member and that are joined between the tubular damper member and the striking section of the outer shell so as to resiliently support the tubular damper member within the outer shell;

the foam materials of the resilient portion comprising:

(i) a first foam material defining an inner foam layer (a) that is joined to the tubular damper member, (b) that extends about a circumference of the tubular damper member, and (c) that is under resilient compression between the tubular damper member and the striking section of the outer shell which surrounds the tubular damper member; and (ii) a second foam material defining an outer barrier layer between the inner foam layer and the outer shell, the second foam material differing from the first foam material such that the outer barrier layer is less compressible than the inner foam layer;

a first adhesive bonding the second foam material to the outer shell; and a second adhesive bonding the second foam material to the first foam material between the inner foam layer to the outer barrier layer;

the first adhesive and the second adhesive being different from one another;

and the second foam material of the barrier layer being resistant to migration of the first adhesive therethrough.

2. The bat according to claim 1 wherein the first adhesive comprises polyurethane.

3. The bat according to claim 1 wherein an outer diameter of the damper member is between 1.375 and 1.75 inches.

4. The bat according to claim 1 wherein the damper member is formed of ultra high molecular weight polyethylene.

5. The bat according to claim 1 wherein an inner diameter of the damper member is greater than 1 inch.

6. The bat according to claim 1 wherein the first foam material of the inner foam layer is heat welded to the damper member.

7. The bat according to claim 1 wherein the first foam material of the inner foam layer is heat welded to the damper member at axially opposed ends of the damper member.

8. The bat according to claim 1 wherein the first foam material of the inner foam layer is compressible to less than half a thickness of the material in a relaxed state.

9. The bat according to claim 1 wherein the first foam material of the inner foam layer is a high density polyurethane foam.

10. The bat according to claim 1 wherein the first foam material of the inner foam layer is a closed cell foam.

11. The bat according to claim 1 wherein the first foam material of the inner foam layer has a radial thickness of at least 0.25 inches in a relaxed state.

12. The bat according to claim 1 wherein the second foam material of the outer barrier layer is an open cell expanded polyethylene foam material.

13. The bat according to claim 1 wherein the second foam material of the outer barrier layer has a radial thickness of 0.125 inches in a relaxed state.

14. The bat according to claim 1 wherein the outer shell comprises a composite material of fibers within a resin.

15. The bat according to claim 1 wherein a length of the damper member is less than 4 inches in a longitudinal direction of the outer shell such that the damper member is spaced farther from an end of the outer shell than a length of the damper member in a longitudinal direction of the outer shell.

16. A baseball bat comprising:

an outer shell formed of a composite material of fibers and resin, the outer shell including a striking section of a first diameter, a handle section of a second diameter which is reduced relative to the first diameter and a tapered section extending between the tubular striking section and the handle section, the striking section including a hollow cavity therein;

a tubular damper member received within a portion of the hollow cavity, the tubular damper member being reduced in diameter relative to the hollow cavity, the tubular damper member being formed of ultra high molecular weight polyethylene;

a resilient portion formed of foam materials that are more compressible than the tubular damper member and that are joined between the tubular damper member and the striking section of the outer shell so as to resiliently support the tubular damper member within the outer shell;

the foam materials of the resilient portion comprising:

(i) a first foam material formed of a high density polyurethane foam defining an inner foam layer (a) that is joined to the tubular damper member, (b) that extends about a circumference of the tubular damper member, and (c) that is under resilient compression between the tubular damper member and the striking section of the outer shell which surrounds the tubular damper member; and (ii) a second foam material formed of an expanded polyethylene foam defining an outer barrier layer between the inner foam layer and the outer shell, the second foam material differing from the first foam material such that the outer barrier layer is less compressible than the inner foam layer;

a first adhesive bonding the second foam material to the outer shell; and a second adhesive bonding the second foam material to the first foam material between the inner foam layer to the outer barrier layer;

the first adhesive and the second adhesive being different from one another;

and the second foam material of the barrier layer being resistant to migration of the first adhesive therethrough.

* * * * *